US010796847B2

(12) United States Patent
Kato

(10) Patent No.: US 10,796,847 B2
(45) Date of Patent: Oct. 6, 2020

(54) IGNITION COIL FOR INTERNAL COMBUSTION ENGINES

(71) Applicant: DENSO CORPORATION, Kariya, Aichi-pref. (JP)

(72) Inventor: Akihiro Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 114 days.

(21) Appl. No.: 15/485,612

(22) Filed: Apr. 12, 2017

(65) Prior Publication Data

US 2017/0301461 A1 Oct. 19, 2017

(30) Foreign Application Priority Data

Apr. 13, 2016 (JP) ..... 2016-080623

(51) Int. Cl.

| | |
|---|---|
| ***H01F 38/12*** | (2006.01) |
| ***H01F 27/32*** | (2006.01) |
| *H01F 5/02* | (2006.01) |
| *F02P 3/02* | (2006.01) |

(52) U.S. Cl.

CPC ..... *H01F 38/12* (2013.01); *H01F 27/325* (2013.01); *F02P 3/02* (2013.01); *H01F 2005/025* (2013.01)

(58) Field of Classification Search

CPC .. H01F 38/12; H01F 27/325; H01F 2005/025; F02P 3/02

USPC ..... 123/634

See application file for complete search history.

(56) References Cited

U.S. PATENT DOCUMENTS

| | | | | |
|---|---|---|---|---|
| 5,349,320 | A | 9/1994 | Suzuki et al. | |
| 5,767,758 | A * | 6/1998 | Sakamaki | H01F 38/12 336/107 |
| 6,114,935 | A * | 9/2000 | Oosuka | H01F 38/12 336/107 |
| 6,208,231 | B1 | 3/2001 | Oosuka et al. | |
| 6,332,458 | B1 * | 12/2001 | Shimada | H01F 41/064 123/634 |
| 6,337,617 | B1 | 1/2002 | Kato et al. | |
| 6,525,636 | B1 | 2/2003 | Oosuka et al. | |
| 6,977,574 | B1 | 12/2005 | Sugiura et al. | |
| 7,068,135 | B1 | 6/2006 | Sugiura et al. | |
| 2003/0122645 | A1 | 7/2003 | Oosuka et al. | |
| 2005/0077990 | A1 | 4/2005 | Kawai et al. | |
| 2005/0212636 | A1 | 9/2005 | Kawai et al. | |

(Continued)

FOREIGN PATENT DOCUMENTS

| | | |
|---|---|---|
| JP | 10-326717 | 12/1998 |
| JP | 2007-81085 | 3/2007 |
| JP | 2010-27669 | 2/2010 |

*Primary Examiner* — Lindsay M Low
*Assistant Examiner* — Omar Morales
(74) *Attorney, Agent, or Firm* — Nixon & Vanderhye P.C.

(57) ABSTRACT

An ignition coil for an internal combustion engine, provided with a primary coil, a secondary coil, a bobbin, a center core and a mold resin member. The primary coil and secondary coil are magnetically connected to each other. The primary coil is directly wound on the bobbin. The center core is disposed in close contact with the bobbin at an inner space thereof. The mold resin member has the primary coil, the secondary coil, the bobbin, and the center core embedded at the inner side thereof. The bobbin includes thermoplastic resin and dispersed phase particles which are dispersed in the thermoplastic resin. The dispersed phase particles being lower in elasticity than the thermoplastic resin.

13 Claims, 13 Drawing Sheets

(56) References Cited

U.S. PATENT DOCUMENTS

| | | | | |
|---|---|---|---|---|
| 2009/0009275 | A1* | 1/2009 | Wada | H01F 38/12<br>336/83 |
| 2013/0284157 | A1* | 10/2013 | Deguchi | F02P 23/00<br>123/634 |

* cited by examiner

IGNITION COIL FOR INTERNAL COMBUSTION ENGINES

CROSS-REFERENCE TO RELATED APPLICATION

This application is based on and claims the benefit of priority from earlier Japanese Patent Application No. 2016-80623, filed on Apr. 13, 2016, the description of which is incorporated herein by reference.

TECHNICAL FIELD

The present invention relates to an ignition coil for an internal combustion engine and more specifically relates to an ignition coil provided with a primary coil which is directly wound around a bobbin, and a center core disposed in close contact with the bobbin at an inner side thereof.

RELATED ART

Ignition coils used in engines, for example, internal combustion engines are provided with a primary coil, a secondary coil and a center core for example. The ignition coil may also include a bobbin with the center core disposed at an inner space of the bobbin. The Japanese Patent JPT-B-2981702 discloses an ignition coil for an internal combustion engine which includes a primary coil and secondary coil magnetically connected to each other and a center core disposed at an inner space of a bobbin. The bobbin forms an insert with the center core inserted in the inner space of the bobbin. It is noted that the center core is made from metal and the bobbin is made from resin.

However, in the configuration described, the bobbin is formed so that the center core inserted at the inner space thereof, with a difference in linear expansion coefficients between the center core and a resin bobbin. In this type of configuration it is considered that thermal stress caused by the difference in the linear expansion coefficients between the bobbin and the center core, interacts with the bobbin which in turn may cause the bobbin to crack. If a crack is formed from an inner radial end to an outer radial end of the bobbin, it may not be possible to maintain electrical insulating properties between the center core inserted at the inner space of the bobbin and a primary coil wound on an outer peripheral-side of the bobbin.

SUMMARY

In view of the foregoing, the present disclosure aims to provide an ignition coil for an internal combustion engine, which maintains insulating properties between an inner peripheral-side and an outer peripheral-side of a bobbin which has a center core embedded at an inner space thereof.

A mode of the present disclosure is an ignition coil for an internal combustion engine provided with a primary coil magnetically connected to a secondary coil, the primary coil being directly wound on a bobbin, a center core which is in close contact with the bobbin disposed at an inner space of the bobbin, and a mold resin member provided with the primary coil, the secondary coil, the bobbin and the center core embedded at the inner side thereof. The bobbin having an axial direction and an inner space extending in the axial direction, is provided with a thermoplastic resin and dispersed phase particles which are dispersed in the thermoplastic resin. The dispersed phase particles being lower in elasticity than the thermoplastic resin.

The bobbin for the ignition coil according to the present disclosure is made of the thermoplastic resin and dispersed phase particles. The dispersed phase particles have a lower elasticity than the thermoplastic resin. As a result, prevention of a crack forming from the inner radial end to the outer radial end of the bobbin can be achieved, as will be described in further detail in the specifications. Insulating properties between the center core disposed at the inner side of the bobbin and the primary coil wound on the bobbin can also be secured.

The mode set forth provides an ignition coil for an internal combustion engine that secures insulating properties between the inner peripheral side and the outer peripheral side of the bobbin which has the center core embedded at the inner space thereof.

It is noted that the symbols set forth in the claims and the summary are provided to explicitly describe the preferred embodiment and do not limit the technical scope of the invention.

DETAILED DESCRIPTION OF THE EMBODIMENTS

Preferred Embodiment

Figure 1:
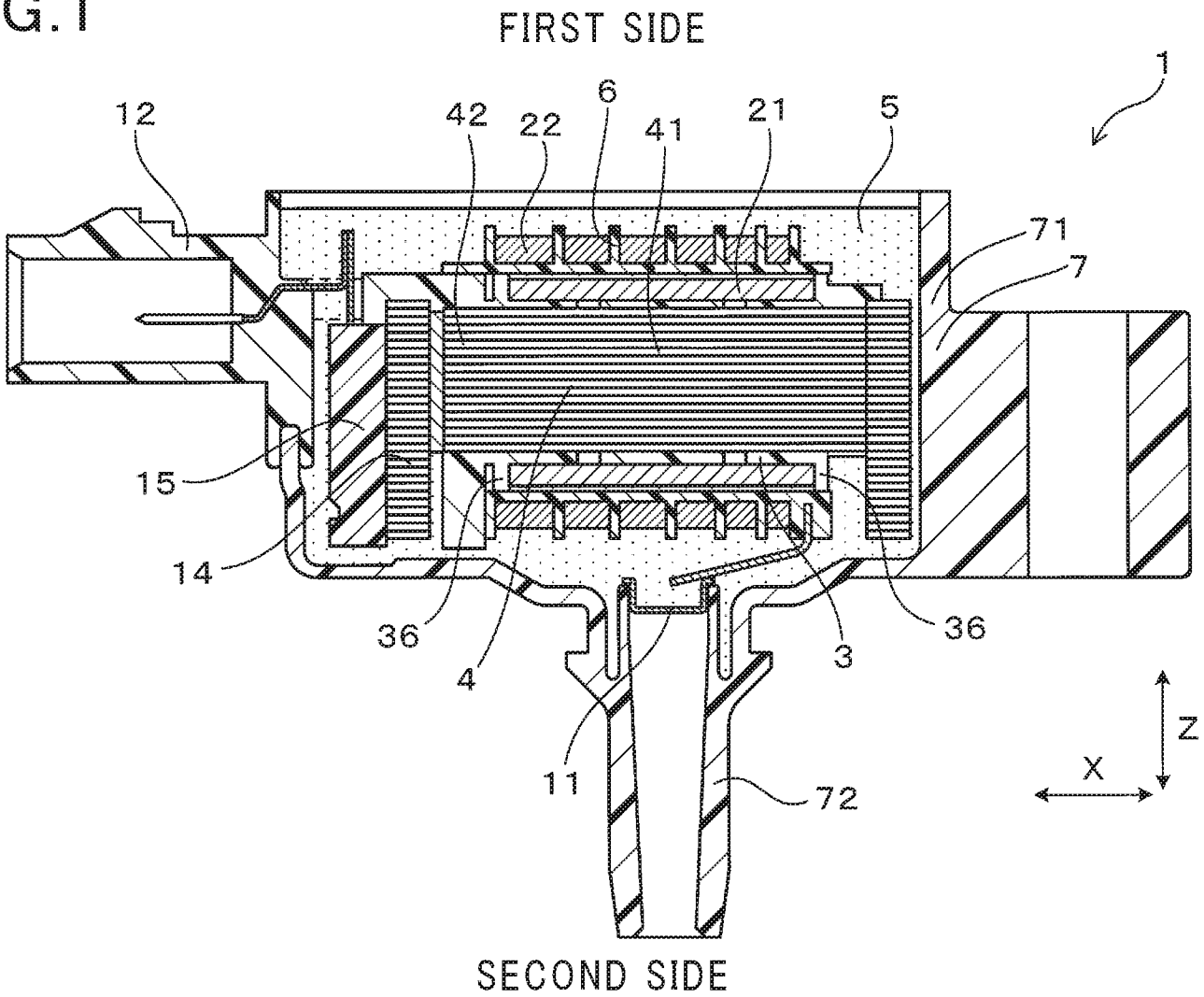
FIG. 1 is a cross sectional diagram of an ignition coil according to a preferred embodiment.
Figure 5:
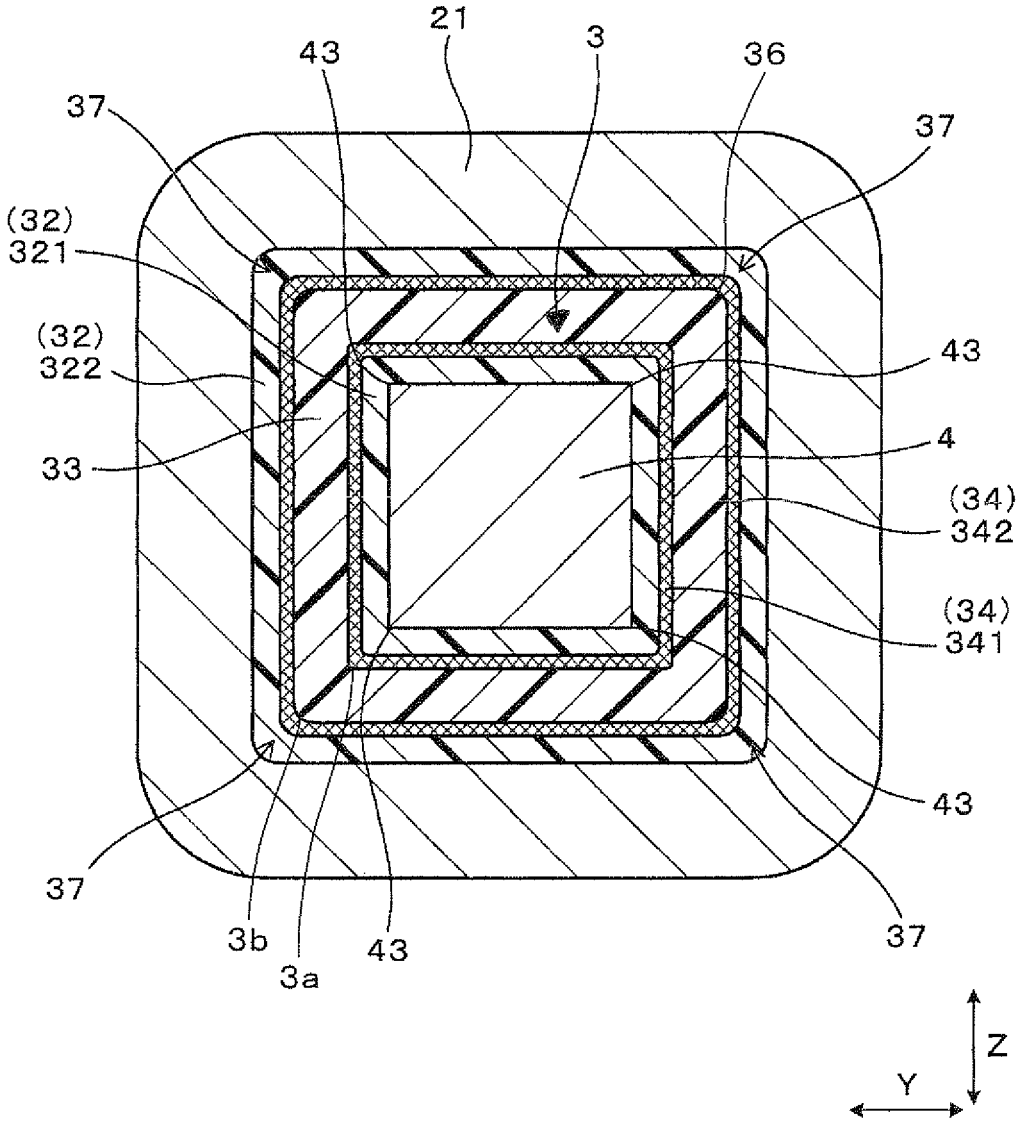
FIG. 5 is a diagram of a cross sectional view of an arrow V-V shown in FIG. 2.
Figure 6:
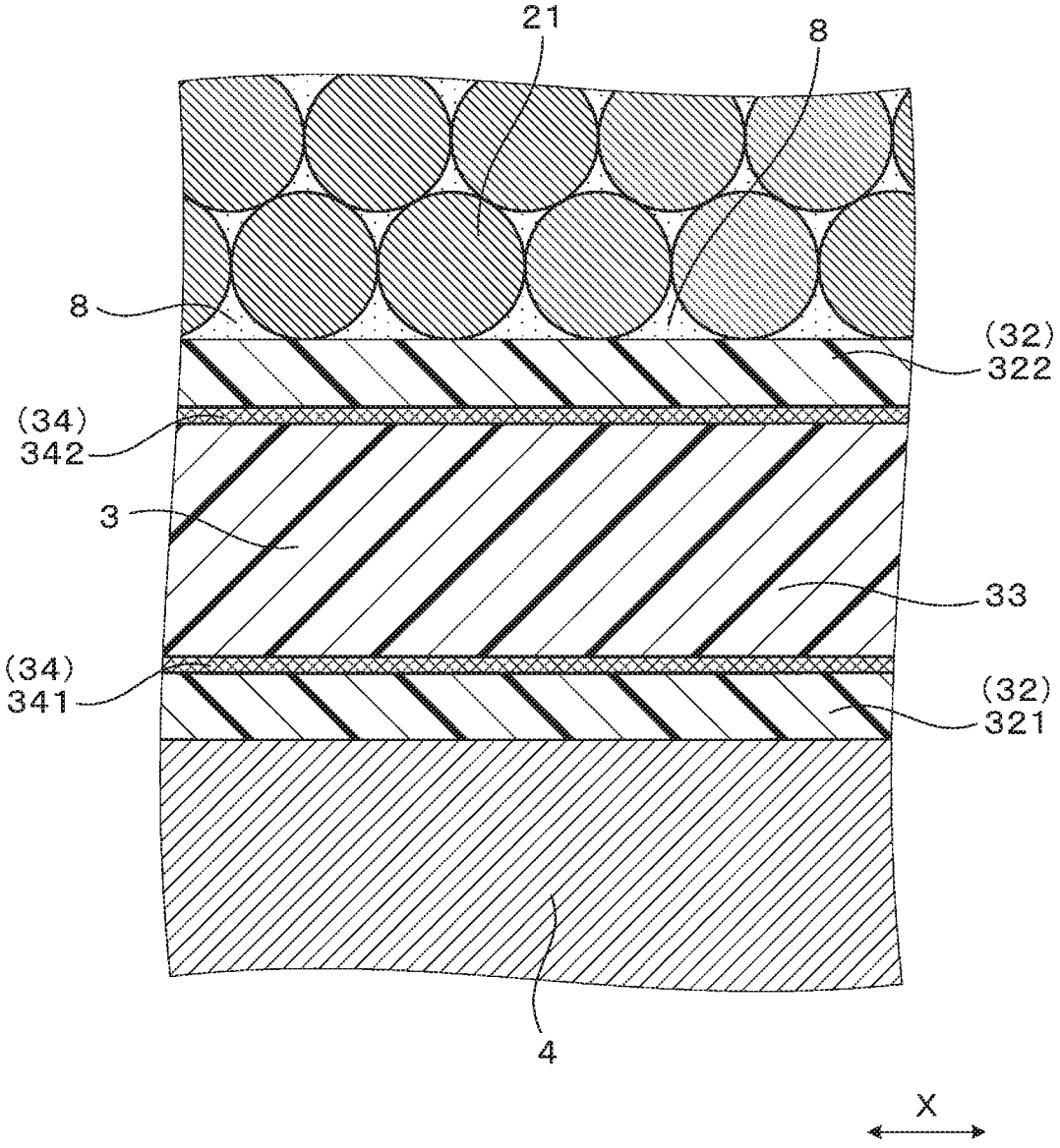
FIG. 6 is an enlarged cross sectional view of an area surrounding the bobbin shown in FIG. 5.

The ignition coil 1 for an internal combustion engine according to the preferred embodiment is described, with reference to FIG. 1 to FIG. 14. As shown in FIG. 1, the ignition coil 1 for an internal combustion engine is provided with a primary coil 21 and a secondary coil 22, a bobbin 3, a center core 4 and a mold resin member 5. The primary coil 21 and the secondary coil 22 are magnetically connected to each other. The primary coil 21 is directly wound on the bobbin 3. The center core 4 is disposed so that the center core 4 is in close contact with the bobbin 3 at an inner space thereof. The mold resin member 5 has the primary coil 21, the secondary coil 22, the bobbin 3 and the center core 4 embedded at an inside of the mold resin member 5. With reference to FIG. 5 and FIG. 6, the bobbin 3 is provided with a thermoplastic resin and dispersed phase particles dispersed inside the thermoplastic resin. The dispersed phase particles are lower in elasticity than the thermoplastic resin.

The ignition coil 1 according to the preferred embodiment can be used in an internal combustion engine of a vehicle or a cogeneration system for example. It is noted that, a winding axial direction of the primary coil 21 and the secondary coil 22 is defined as an X direction hereon. The X direction is also a lengthwise direction of the bobbin 3 and the center core 2.

As shown in FIG. 1, the center core 4 is a flat steel plate made of a soft magnetic material. A plurality of the steel plates are laminated in a thickness direction to form the center core 4. Incidentally, the steel plates are laminated in a direction orthogonal to the X direction. The laminated direction of the steel plates forming the center core 4 will be referred to as a Z direction, and the direction that is orthogonal to both the X direction and the Z direction will be referred to as a Y direction hereinafter. A side view of the bobbin 3 having the center core 4 in close contact at the inner space thereof is shown, having the axial direction (Ax), circumferential direction (CIRC) and radial direction (RAD) as indicated.

Figure 3:
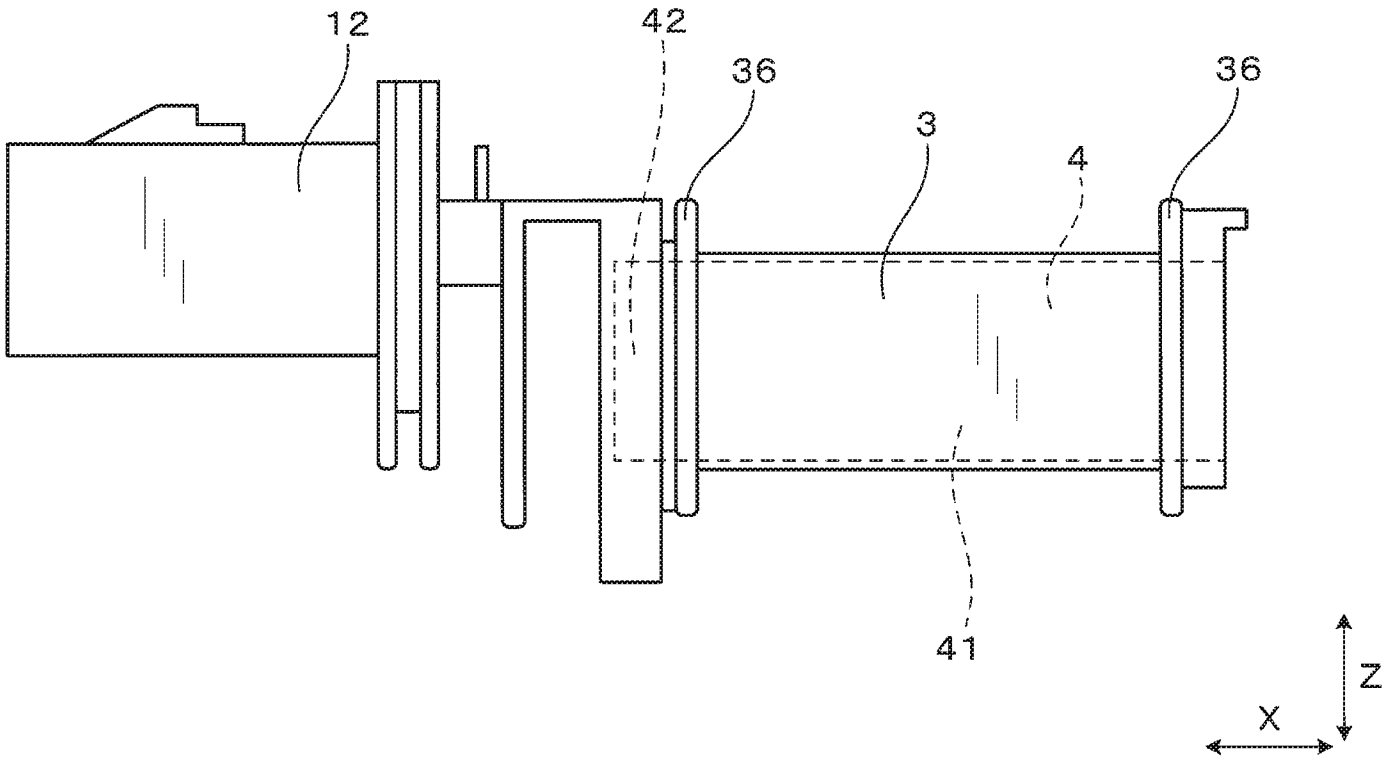
FIG. 3 is diagram of a side view in the Y direction of the bobbin and the connector according to the preferred embodiment.
Figure 4:
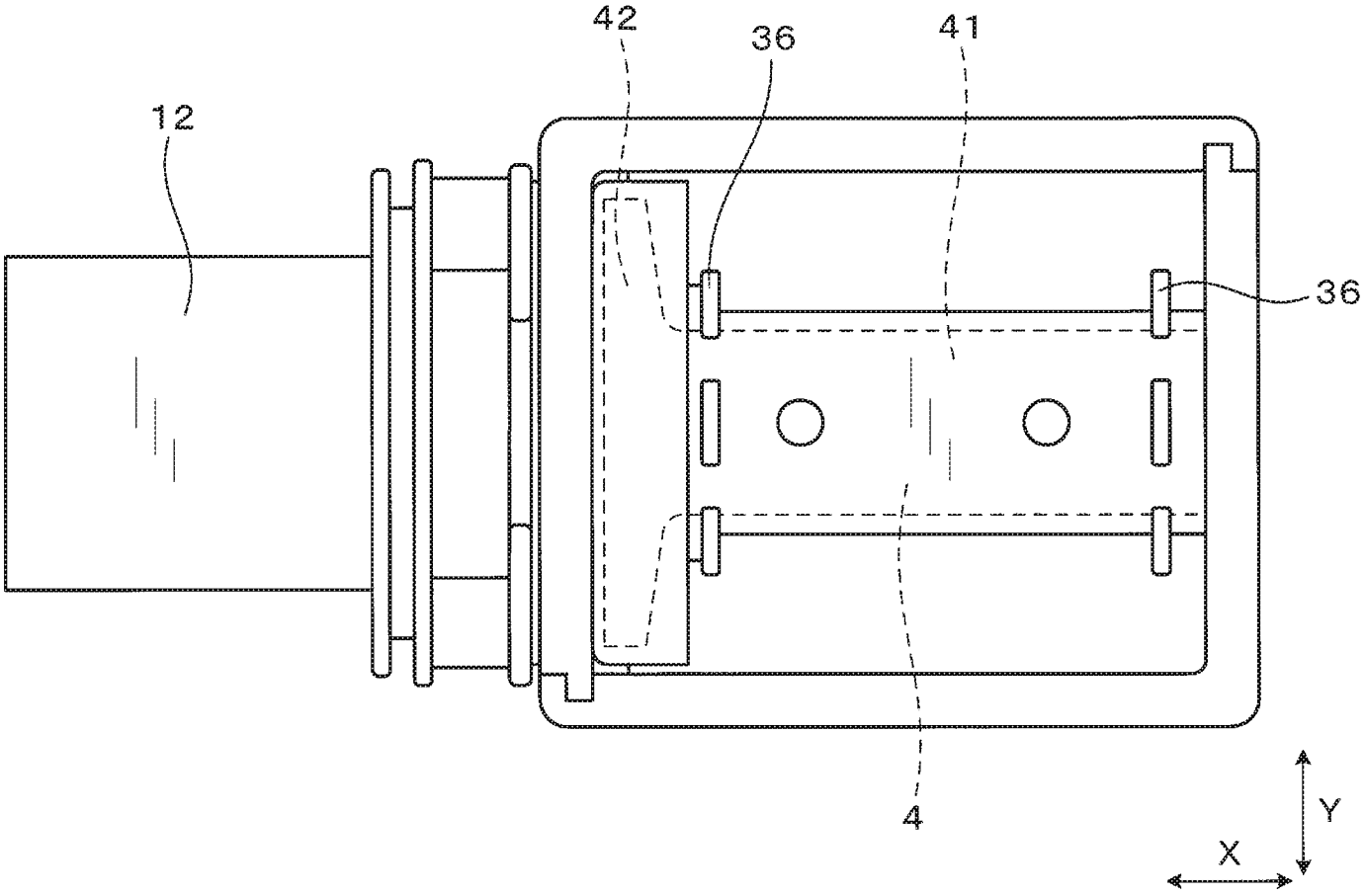
FIG. 4 is diagram of a bottom view from a Z direction of the bobbin and the connector according to the preferred embodiment.

As shown in FIG. 3 and FIG. 4, the center core 4 is provided with a rectangular parallelepiped section 41 that has a rectangular parallelepiped shape and a projected portion 42 provided on an end of the rectangular parallelepiped section 41. The end of rectangular parallelepiped section 41 is referred to as 41*a* hereinafter, as shown in FIG. 4. The projected portion 42 extends in both directions in the Y direction, with respect to the rectangular parallelepiped section 41, which is disposed at the end 41*a* of rectangular parallelepiped section 41 in the X direction. In FIG. 3 and FIG. 4, an outer form of the center core 4 is illustrated with a broken line. The rectangular parallelepiped section 41 has angular portions 43 disposed in four corners of the cross sectional formation orthogonal to the X direction, as shown in FIG. 5.

As shown on FIG. 1, the center core 4 is embedded at the inner side of the bobbin 3 with both end faces exposed in the X direction thereof. The bobbin 3 forms an insert with the center core 4 inserted at the inner space thereof.

The bobbin 3 is a cylindrical formation. As mentioned previously, the bobbin 3 is made from a material which has dispersed phase particles dispersed in the thermoplastic resin. In the preferred embodiment, the thermoplastic resin is a polybutylene terephthalate (PBT resin) and the dispersed phase particles are elastomer. The elastomer has a lower elasticity than polybutylene terephthalate resin. The bobbin 3 has elastomer content ratio in a range of 3 to 10 percent mass.

As shown in FIG. 5 and FIG. 6, the bobbin 3 has two skin layers 32 formed on an inner-peripheral end section and an outer peripheral end section thereof, and a core layer 33 which is formed therebetween the two skin layers 32. The bobbin 3 also has two elastomer layers which will be described in detail hereafter. When the bobbin 3 is formed by pouring the molten resin into a cavity inside a cast which is disposed with the center core 4 at an inner side thereof, the cast and the center core deprive heat from the molten resin, and as a result the skin layers 32 are set at relatively early stage. The core layer 33 is a layer that is set and formed after the skin layers 32. The skin layers 32 and the core layer 33 are a polybutylene terephthalate resin with elastomer particles dispersed inside.

The elastomer layer 34 is formed between each of the two skin layers 32 and the core layer 33. The elastomer layer 34 is a layer which has a plurality of elastomer particles cohered and flattened to form a layer of connected elastomer particles. The elastomer layer 34 is formed around a whole circumference of the bobbin 3.

As previously described, since the elastomer has a lower elasticity than polybutylene terephthalate resin, the elastomer layer 34 has a lower strength than the skin layers 32 and the core layer 33, which have elastomer particles dispersed in polybutylene terephthalate resin. For convenience, the two skin layers 32 are will also be individually referred to as an inner-peripheral skin layer 321 for a layer formed on an inner-peripheral side, and an outer-peripheral skin layer 322 for a skin layer formed on an outer peripheral side. Additionally, the two elastomer layers 34 will also be individually referred to as an inner peripheral elastomer layer 341 for a layer formed on the inner peripheral-side, and an outer peripheral elastomer layer 342 for a layer formed on an outer peripheral-side.

Figure 2:
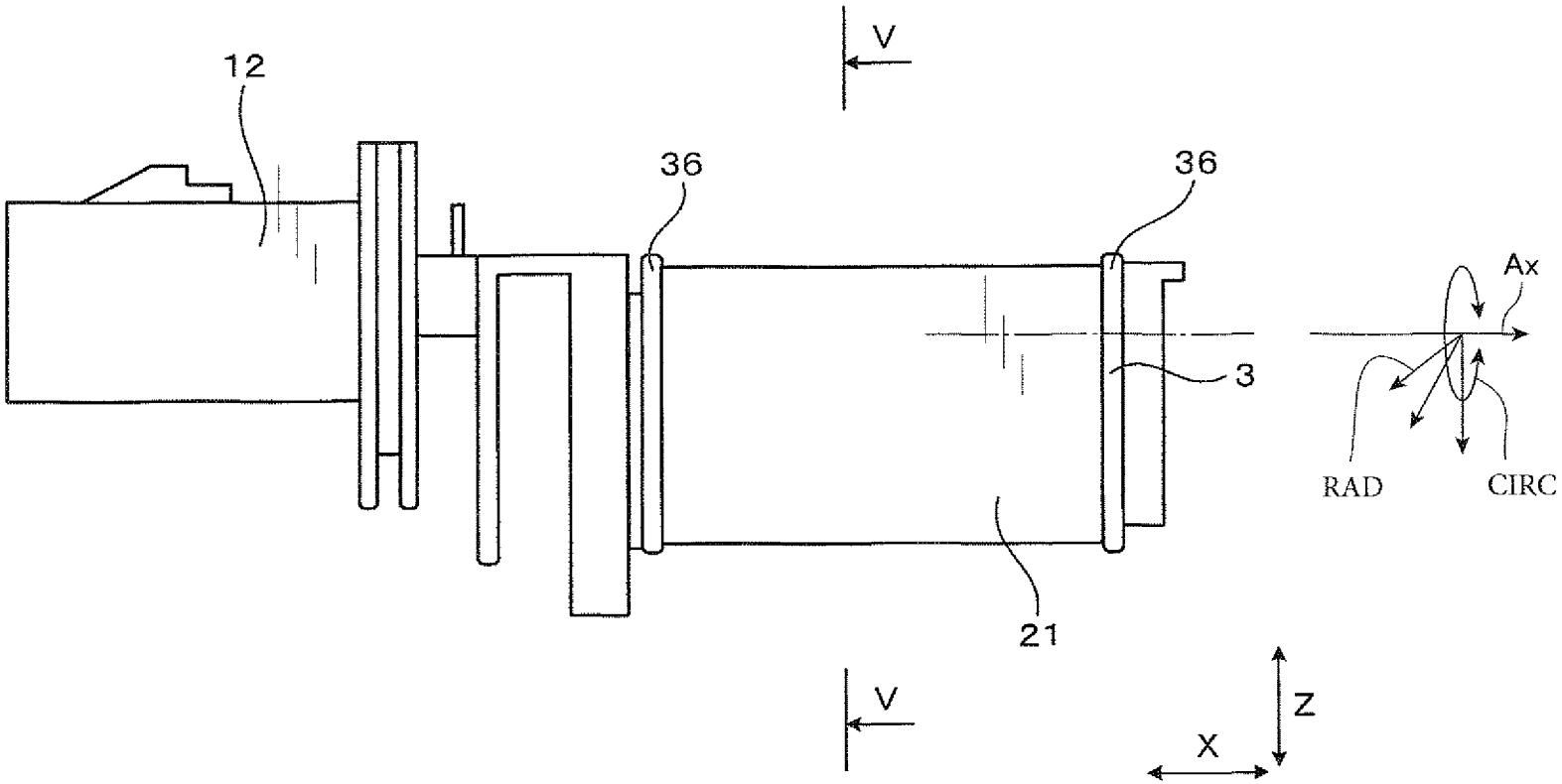
FIG. 2 is diagram of a side view in a Y direction of a bobbin, a primary coil and a connector according to the preferred embodiment.

With reference to FIG. 1 to FIG. 4, the bobbin 4 has a pair of rim sections 36 which extend to an outer peripheral side thereof. The pair of rim sections 36 are provided at a fixed interval from each other in the X direction. As shown in FIG. 1 and FIG. 2, the primary coil 21 is wound between the pair of rims 36 on the bobbin 3. Additionally, the primary coil 21 is wound on an outer peripheral side of the rectangular paralleled section 41 of the center core 4, as shown in FIG. 1. More specifically, as shown in FIG. 5 and FIG. 6, the coil 21 is wound on the outer-peripheral side to contact an outer surface of the bobbin 3.

As shown in FIG. 1, a bobbin 6 for the secondary coil 22 is disposed at an outer side of the primary coil 21. The secondary coil 22 is wound around the bobbin 6 which is provided for the secondary coil 22. The primary coil 21 and the secondary coil 22 are concentrically disposed to be stacked at an inner and outer periphery thereof.

The ignition coil 1 is provided with a case 7. The case 7 has a case body 71 which accommodates the primary coil 21 and the secondary coil 22, the bobbin 3, the center core 4, and other parts of the ignition coil 1 inside. One side of the case body 71 in the Z direction is opened. The opened side of the case body hereon will be referred to as a first side of the case body 71 and an opposing side will be referred to as a second side. The second side of the case body being opposed in the Z direction to the first side of the case body 71. The case 7 is provided with a cylindrical high voltage tower section 72, disposed on the opposing side of the first side, which is the second side of the case body 71. The high voltage tower 71 is formed as a projected section extending in the Z direction from the second side of the case body 71. A metallic high voltage output terminal 11 is fitted at a side end section of the case body 71 of the case 7.

As a result, the side end section on the second side of the case body 71 of the high voltage tower section 71 is thus closed off. In addition to the center core 4, other configuring parts of the ignition coil 1, for example, include an outer core 14 disposed on an outer-side of the secondary coil 22 which forms a closed magnetic circuit, and an igniter 15 which provides a power supply and shuts off a power supply to the primary coil 21.

Figure 7:
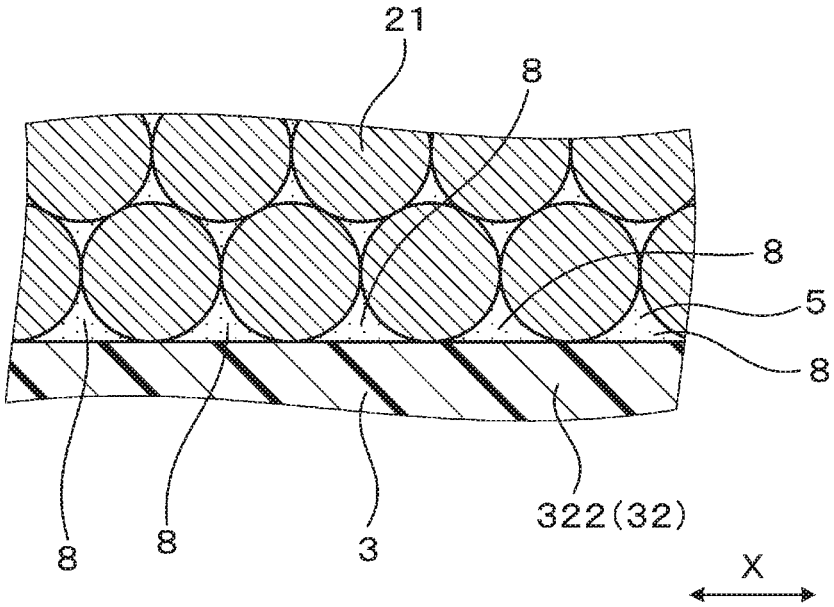
FIG. 7 is an enlarged view of a boundary area between the bobbin and the primary coil shown in FIG. 6.

A mold resin member 5 is filled inside the case body 71. The mold resin member 5 is an epoxy resin, for example. The primary coil 21 and the secondary coil 22, the bobbin 3, center core 4 and other parts configuring the ignition coil 1 are embedded inside the mold resin member 5. As shown in FIG. 6 and FIG. 7, the mold resin member 5 is also impregnated in minute regions 8 between the primary coil 21 and the outer surface of the bobbin 3. As a result, the mold resin member 5 is adhered to the bobbin 3.

As shown in FIG. 1, inside the case body 71, a connector 12 is fixed to connect the ignition coil 1 with an outer side thereof. In the preferred embodiment, the connector 12 is formed with the bobbin 3 as one part. It is noted that the connector 12 may also be formed as a separate part of the bobbin 3.

Subsequently, movement of the elastomer particles and a formational change thereof when the bobbin 3 is formed, will be described with reference to FIG. 8 to FIG. 11. For convenience, an elastomer particle 31 is labelled in FIG. 8 and FIG. 9.

Figure 8:
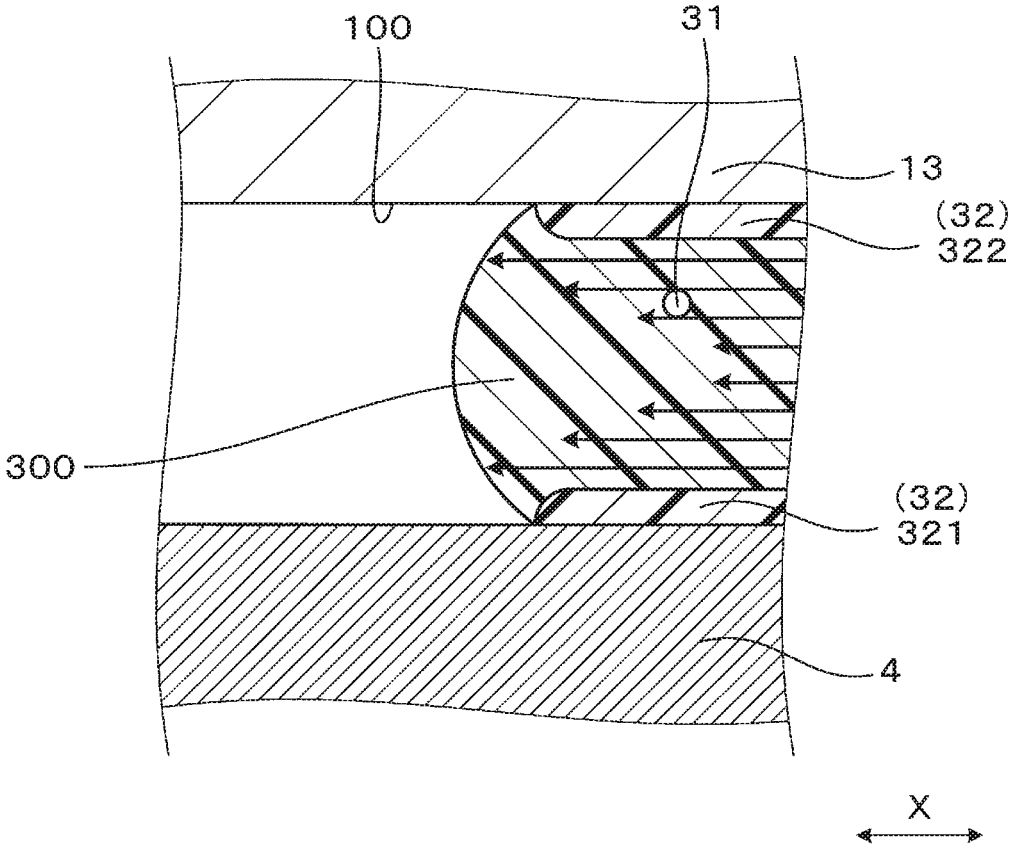
FIG. 8 is a schematic view showing a flowing state of a molten resin which forms the bobbin, according to the preferred embodiment.

As shown in FIG. 8, in order to form the bobbin 3, a molten resin 300 is poured and flowed into a cavity 100 inside a cast 13 which is disposed with the center core 4 at an inner space thereof. The molten resin 300 is specifically elastomer particles as the dispersed phase particles, dispersed in polybutylene terephthalate resin, in which the elastomer content is in the range of 3 to 10 mass percent.

Incidentally, parts of the cast 13 and the center core 4 that have contact with the molten resin 300 poured and flowed in the cavity 100, easily deprive heat from the molten resin 300. As a result, the skin layer 32 is set and formed at relatively early stage.

Figure 9:
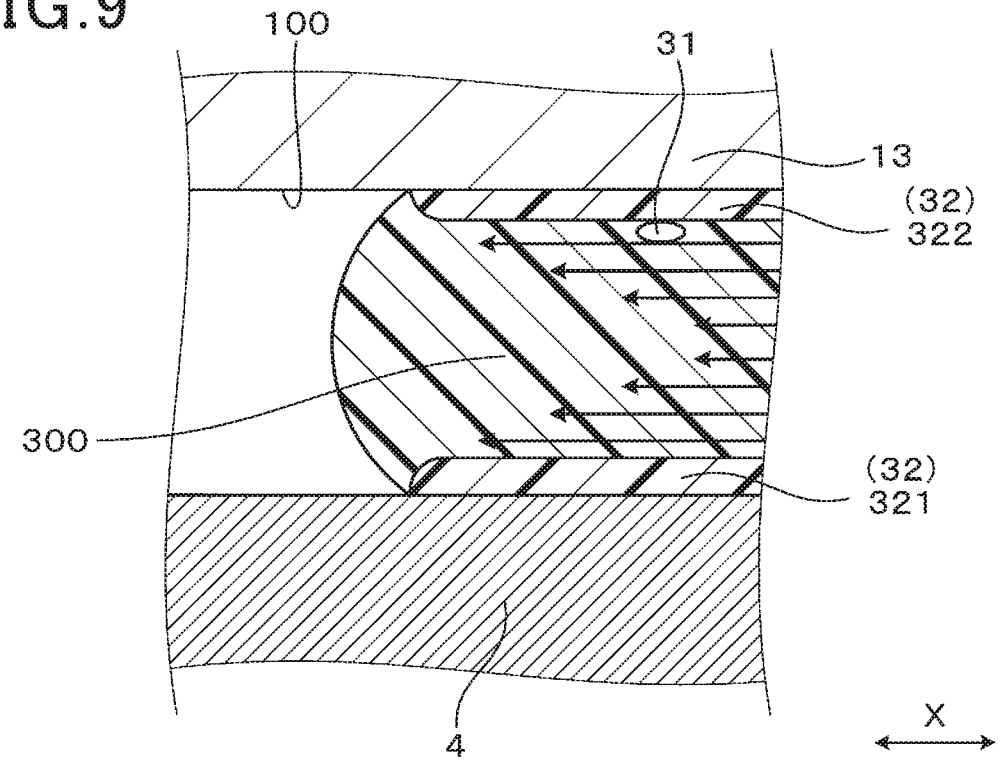
FIG. 9 is a schematic view showing a formational changing state and moving state of an elastomer particle in the molten resin which forms the bobbin, according to the preferred embodiment.
Figure 10:
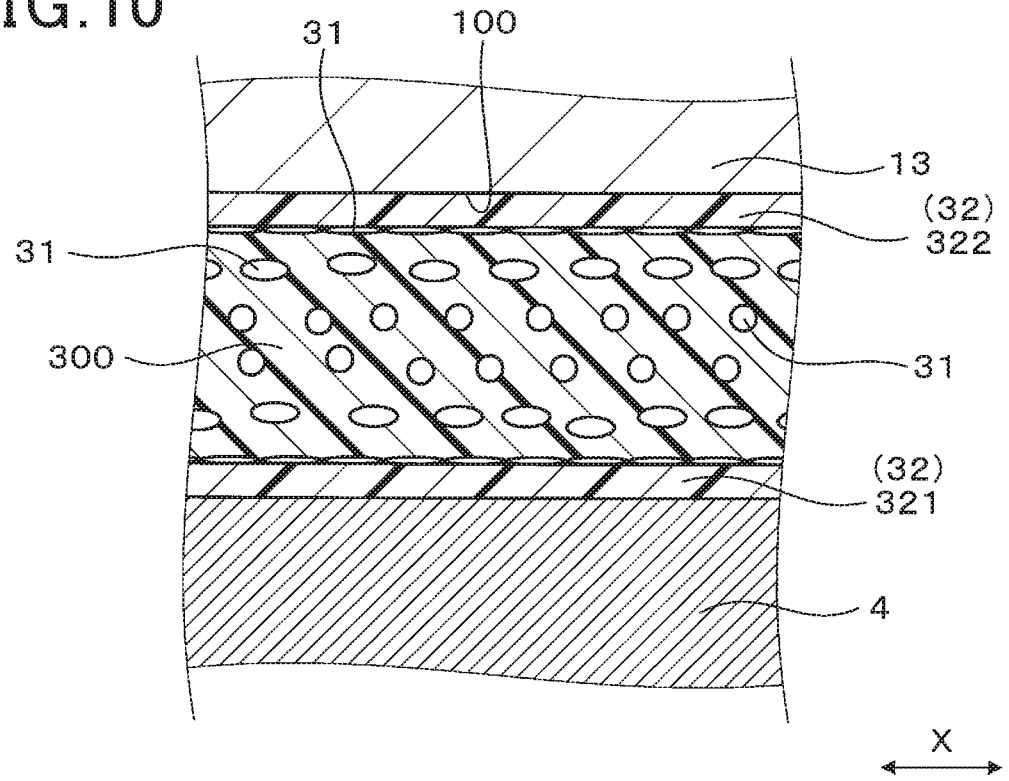
FIG. 10 is a schematic view showing formations of a plurality of elastomer particles in the molten resin that forms the bobbin, the elastomer particles having different formations depending on a direction in which skin layers are facing to each other, according to the preferred embodiment.

The molten resin 300 flowing between the set skin layers 32, generates a shear velocity gradient at an opposing side of the skin layers 32. The shear velocity of the molten resin 300 flowing between the skin layers 32 increases as the molten resin 300 approaches a region that is close to a side of the skin layer 32 and becomes a highest velocity at a region which is adjacent to the skin layers 32. As a result, the dispersed elastomer particles 31 in the molten resin 300 flowing between the skin layers 32, moves towards the side of the skin layers 32 where the shear velocity is high, as shown in FIG. 9. The skin layers 32, herein referred to as the inner-peripheral skin layer 321 and the outer-peripheral skin layer 322. With reference to FIG. 10, it is noted that the elastomer particles 31 move to the side of the inner-peripheral skin layer 321 and the outer-peripheral skin layer 322, whilst being gradually compressed by an opposed direction due to shear stress. The shear stress is caused by the shear velocity gradient of the opposing direction, which opposes the side of the skin layers 32. In FIG. 8, a vector showing a size and a direction of the shear stress is indicated by arrows. Regarding the arrows shown in FIG. 8, a length of the arrow represents the size of the shear stress. In other words, the greater the shear stress is the longer the arrow appears.

Figure 11:
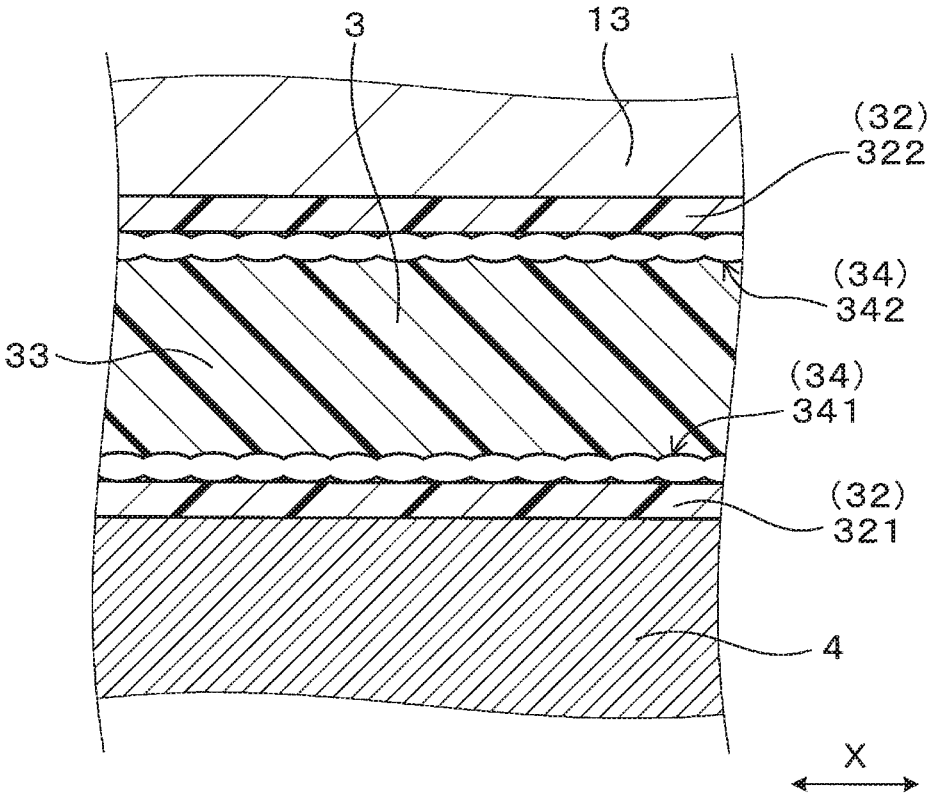
FIG. 11 is a schematic view showing a state of the plurality of elastomer particles in the molten resin that makes the bobbin, cohered on a skin layer surface to form a flattened elastomer layer, according to the preferred embodiment.

As shown in FIG. 10, the elastomer particles 31 which have moved to a surface of the skin layer 32, are compressed further by the opposing direction of the skin layer 32 and flattened due to the shear stress. As described above, movement and formational change of the elastomer particles 31 occur. The movement and formational change of the elastomer particles 31 occurs in the plurality of elastomer particles 31 contained in the molten resin 300. As a result, a plurality of flattened elastomer particles 31 between the skin layer 32 and the core layer 33 are cohered. The plurality of flattened elastomer particles 31 are connected to each other in a circumferential direction of the bobbin 3 and the X direction. As shown in FIG. 5, FIG. 6, and FIG. 11 respectively, as a result, the elastomer layer 34 is formed.

A space layer 35 which is formed on the bobbin 3 will be described in detail later on. An example of how the space layer 35 is formed on the bobbin 3 is described hereinafter. As shown in FIG. 5, when producing the ignition coil 1, the primary coil 21 is directly wound around the bobbin 3 that is formed from the skin layers 32, the core layer 33 and the elastomer layer 43. Winding of the primary coil 21 directly around the bobbin 3 causes stress to the bobbin 3. As a result of the stress, the primary coil 21 fixes the outer peripheral skin layer 322. At this point, if cooling stress is applied to the bobbin 3 which has the outer peripheral skin layer 322 in a bound state, distortion will occur between the outer peripheral elastomer layer 342 and the outer peripheral skin layer 322. In particular, since stress caused by winding the primary coil 21 increases, the binding strength of the outer peripheral skin layer 322 due to the primary coil will also increase as a consequence. The distortion of elastomer layer 342 disposed between the bound outer peripheral skin layer 322 and a core layer 33 which is not bound, is thus increased, and the elastomer layer 342 is in a state in which the layer is easily peeled away.

Figure 12:
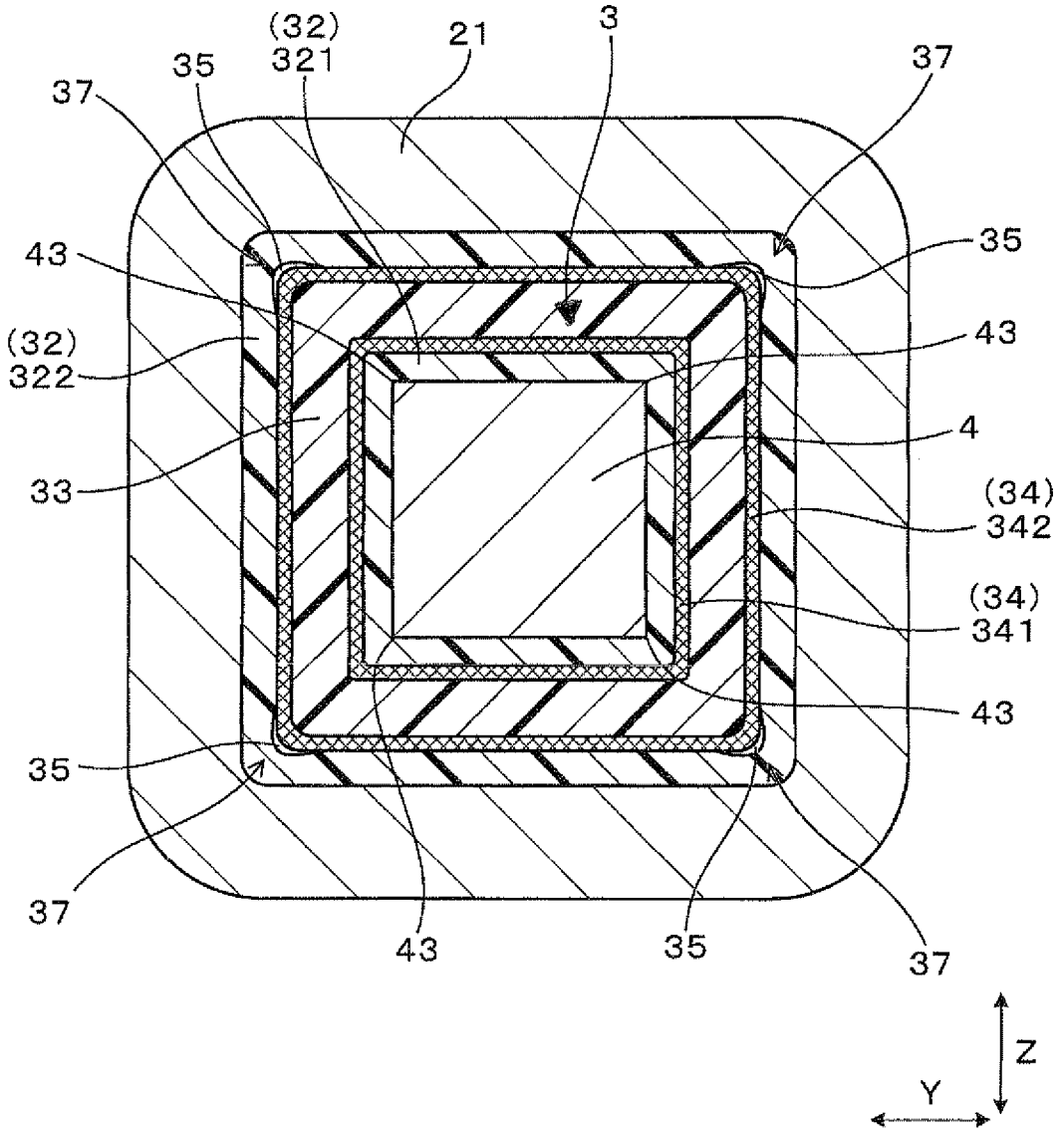
FIG. 12 is a schematic cross sectional view orthogonal to an X direction of the bobbin having a space layer formed, according to the preferred embodiment.
Figure 13:
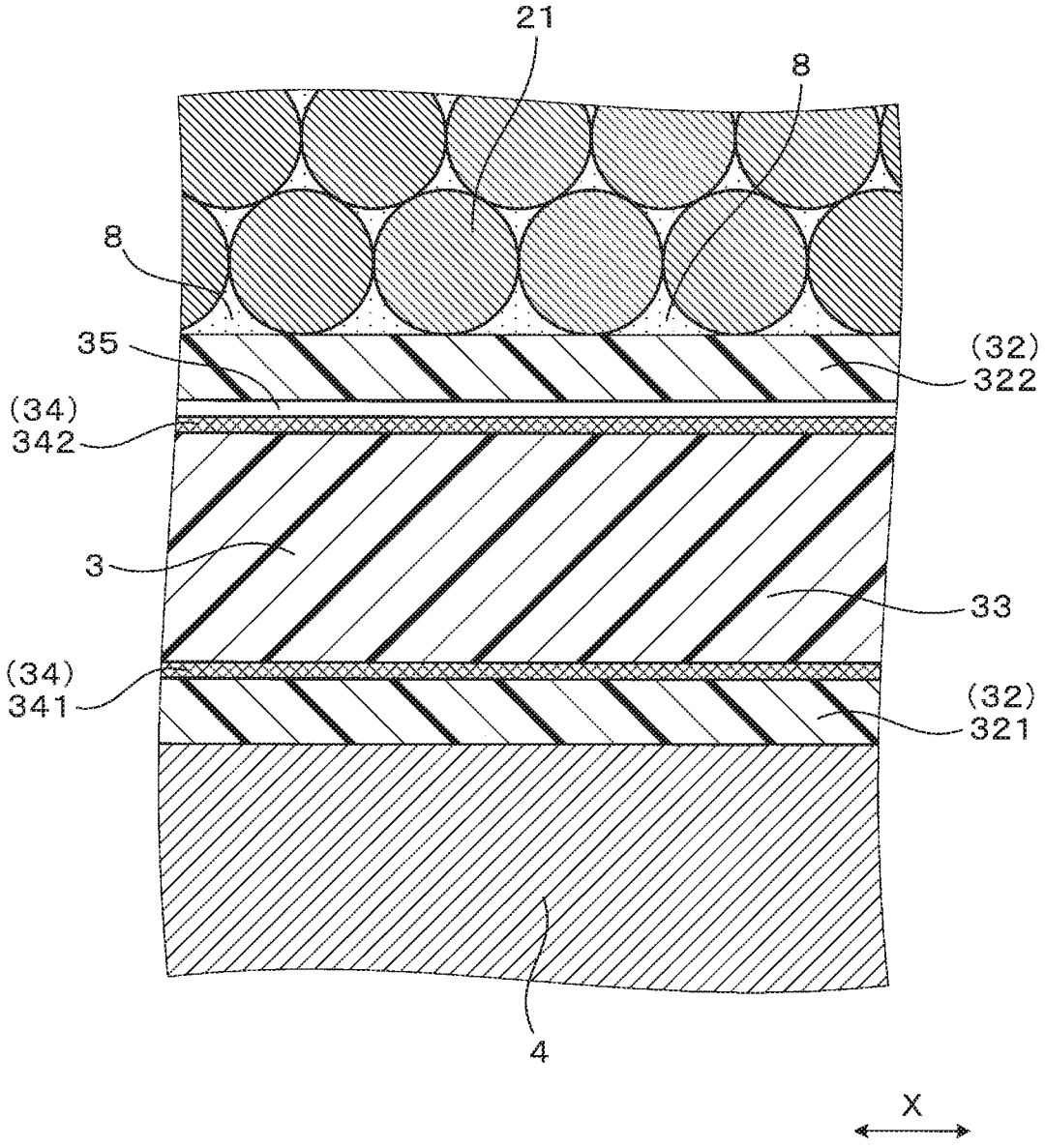
FIG. 13 is an enlargement of a surrounding area of the bobbin shown in FIG. 12.

The bobbin 3 is contacted in the X direction, which is the length wise direction thereof, when a temperature of the ignition coil 1 changes from a high temperature to a low temperature in order to cool the ignition coil 1 during usage. As shown in FIG. 7, the outer peripheral skin layer 322 is fixed by the mold resin member 5, which impregnates into minute regions 8 between the primary coil 21 and the outer surface of the bobbin 3, and is also bound by the primary coil. When the bobbin 3 contracts in the X direction due to cooling of the ignition coil 1, contraction of the outer peripheral skin layer 322 is suppressed compared to an inner peripheral layer. As a result, a relatively large stress is applied between the distorted outer peripheral skin layer 322 and the outer peripheral elastomer layer 342. Furthermore, as shown in FIG. 12 and FIG. 13, peeling occurs between the outer peripheral elastomer layer 342 and the outer peripheral skin layer 322, which results in peeling of both the layers. The space layer 35 is formed from a space or a layer of air between the outer peripheral elastomer layer 342 and the outer peripheral skin layer 322. The space layer 35 is formed on at least an angular portion 37 that has a large binding strength with the outer peripheral skin layer 322, due to the primary coil 21.

The space layer 35 is not formed at the completion of the production of the ignition coil 1, but is formed when using the ignition coil 1 during the cooling process thereof.

Figure 14:
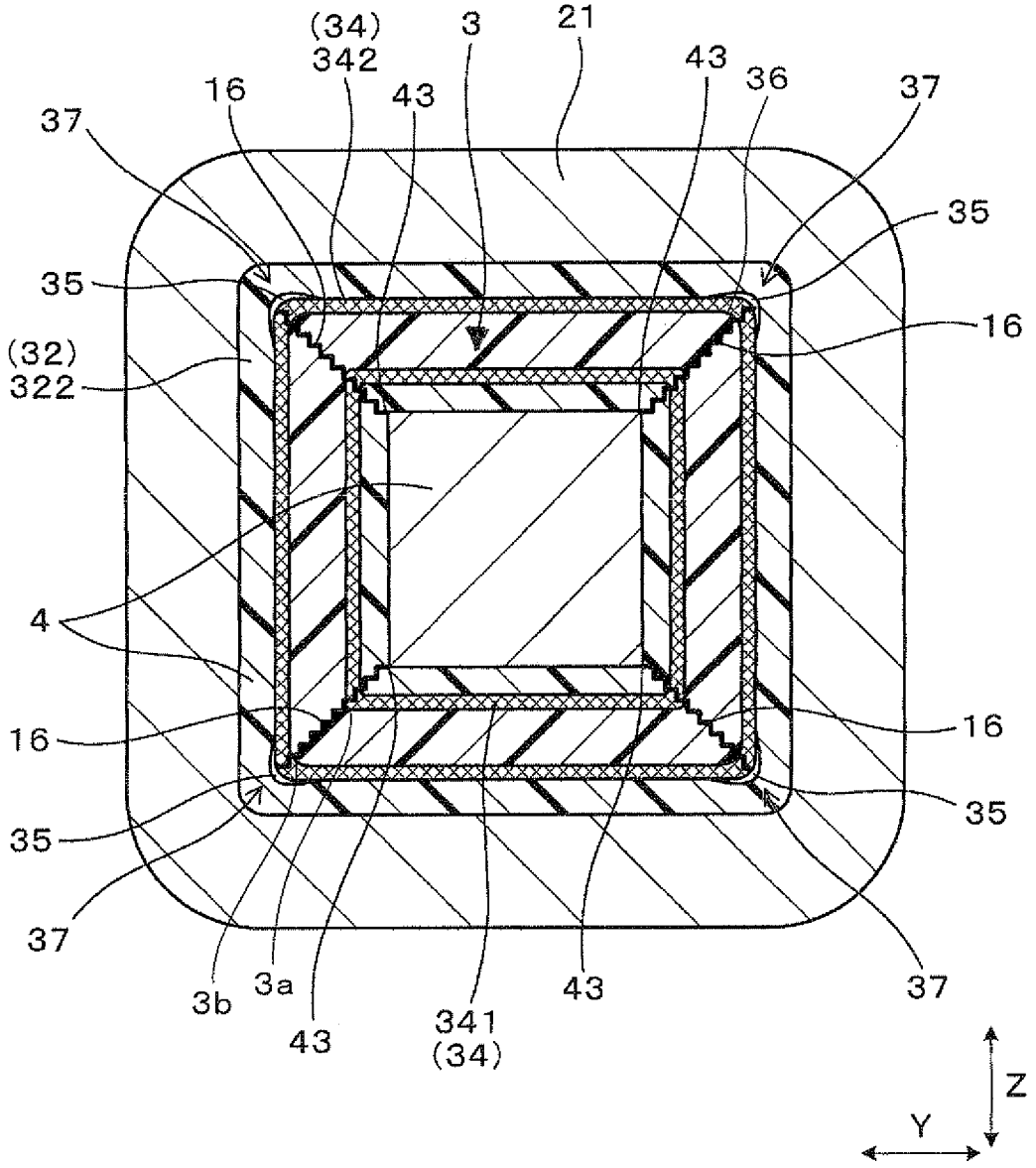
FIG. 14 is schematic view showing an effect of the bobbin, of the preferred embodiment.

An effect of the ignition coil 1 according to the preferred embodiment will now be described. The ignition coil 1 for an internal combustion engine is provided with the bobbin 3 having the thermoplastic resin and dispersed phase particles. The dispersed phase particles have a lower elasticity than the thermoplastic resin. As a result, the space layer 35 is formed on at least the angular section 37. With reference to FIG. 14, supposing that a crack 16 occurs in the bobbin 3 when cooling the ignition coil 1, given that the angular portion 43 of the center core 4 is an origin of the crack 16, the crack 16 can be suppressed from forming a crack which extends from an inner-peripheral end 3*a* to an outer peripheral end 3*b* of the bobbin 3. In this case, cooling stress is considered to easily increase in the center core 4. Even if the crack 16 which originates from the angular portion 43 of the center core 4, progresses toward an outer peripheral-side thereof, the crack 16 will not progress to the outer peripheral skin layer 322 due to the space layer 35 which is formed between the outer peripheral elastomer layer 342 and the outer peripheral skin layer 322. As a result, insulating properties are maintained between the center core 4 disposed at the inner side of the bobbin 3, and the primary coil 21 wound around an outer-side of the bobbin 3.

The dispersed phase particles are elastomer with a lower elasticity than the thermoplastic resin. As a consequence, the dispersed phase particles can easily change formation when producing the bobbin 3. Furthermore, the dispersed phase particles are easily flattened and cohered, which enables an easily peeled elastomer layer 34 to be easily formed.

The thermoplastic resin is a polybutylene terephthalate resin. The elastomer layer 34 can be thus easily formed, while using conventional materials for the bobbin 3. The thermoplastic resin can also be either polyphenylene sulfide resin (PPS), or polyphenylene ether resin (PPE). The same effect is elicited by using either one of the resins.

The elastomer content ratio of the bobbin 3 is in the range of 3 to 10 mass percent. As a result, the elastomer layer 34 formed around an entire circumference of the bobbin 3 is easily obtained, and a strong adherence between the bobbin 3 and molding resin 5 is achieved, which is described in detail in experimental examples.

As described above, the ignition coil 1 for an internal combustion engine can be provided with insulating properties secured between the inner periphery-side and the outer periphery-side of the bobbin, having the center core embedded at the inner side thereof.

Experimental Example 1

With reference to data shown in Table 1, the experimental example 1 is an evaluation of the cohered and flattened state of the elastomer forming the elastomer layer 34, when the elastomer content ratio was variously changed.

In the example 1, a total of 14 samples, which are samples 1 to 14, were constructed and subjected to evaluation. The 14 samples had a same basic structure as the bobbin 3 described in the preferred embodiment, with different elastomer content ratios. Each sample was formed from the polybutylene terephthalate resin with elastomer particles dispersed inside the resin. The elastomer content ratio was 0.0% (mass percent) for sample 1, and 1.0% (elastomer content ratio), 2.0%, 2.5%, 3.0%, 4.0%, 5.0%, 6.0%, 7.0%, 8.0%, 9.0%, 10.0%, 11.0%, and 12.0% for respective samples 2 to 14, as shown in Table 1.

In the first experiment, after each of the samples 1 to 14 were constructed, a cross-section parallel to the X direction of each sample was observed under a microscope, and the cohesion and flattened state of the elastomer of the bobbin 3 was evaluated. The results are shown in Table 1. The evaluation of the cohesion and flattened state of the elastomer of the bobbin 3 was evaluated as; [A] when the elastomer appeared to form a cohered, flattened and a connected elastomer layer 34, in which the elastomer layer was continuously formed in the X direction, [B] when the elastomer layer 34 appeared partially formed in the X direction, and [C] when the elastomer layer 34 appeared to be almost or completely unformed in the X direction. In table 1, [elastomer content ratio] represents the elastomer content ratio of each indicated sample.

TABLE 1

| SAMPLE | ELASTOMER CONTENT RATIO [MASS %] | EVALUATION |
|---|---|---|
| SAMPLE 1 | 0 | C |
| SAMPLE 2 | 1 | C |
| SAMPLE 3 | 2 | C |
| SAMPLE 4 | 2.5 | B |
| SAMPLE 5 | 3 | A |
| SAMPLE 6 | 4 | A |
| SAMPLE 7 | 5 | A |
| SAMPLE 8 | 6 | A |
| SAMPLE 9 | 7 | A |
| SAMPLE 10 | 8 | A |
| SAMPLE 11 | 9 | A |
| SAMPLE 12 | 10 | A |
| SAMPLE 13 | 11 | A |
| SAMPLE 14 | 12 | A |

From table 1, it was found that the elastomer layer 34 had almost or completely not formed in samples 1 to 3 which had an elastomer content ratio of 2% or less. In sample 4, an elastomer content ratio of 2.5% resulted in a partially formed elastomer layer 34 in the X direction thereof. On the other hand, in samples 5 to 14, an elastomer content ratio of 3% or more formed the elastomer layer 34 which was continuously formed in the X direction.

In other words, results from the experiment demonstrated that an elastomer content ratio of 2.5% or more was preferable to form the bobbin 3. That is, the elastomer layer 34 was easily formed if the elastomer content ratio of the bobbin 3 was 2.5% or more. As a result, a crack forming from an inner to an outer radial side of the bobbin 3 can be prevented. Moreover, results from the experiment 1 indicated that the elastomer layer 34 was formed as a continuous layer in the X direction, which was obtained by providing the bobbin 3 with an elastomer content ratio of 3.0% or more.

Experimental Example 2

Figure 15:
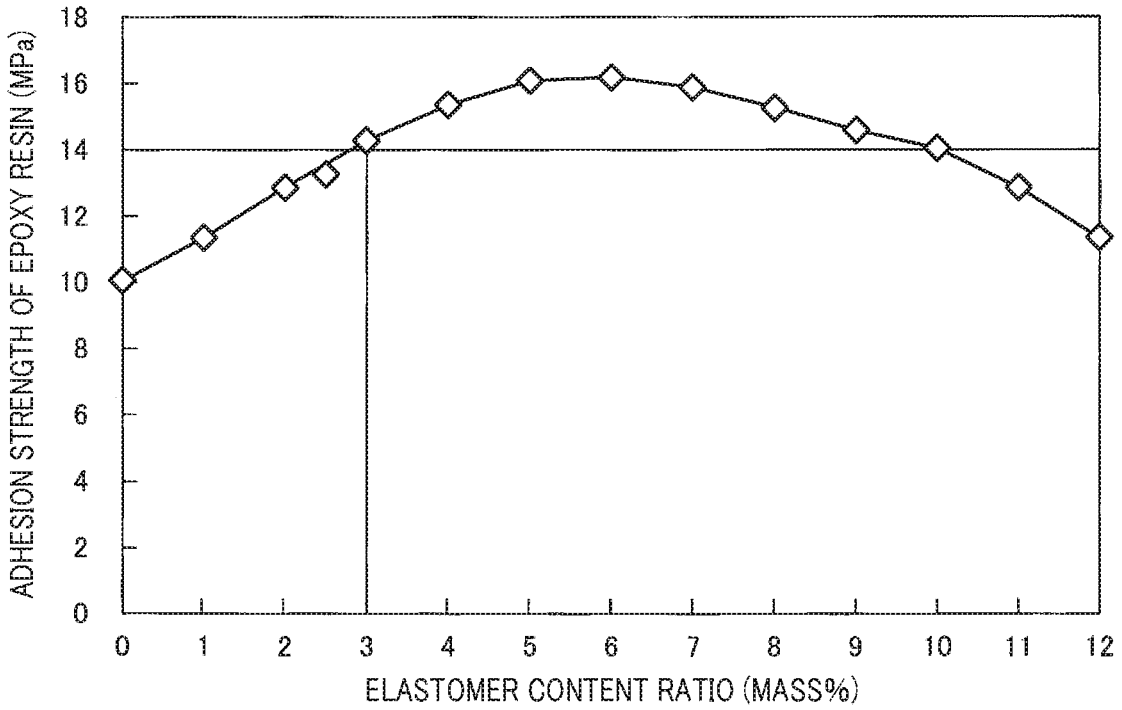
FIG. 15 is a line graph showing a relation between an elastomer content ratio and an adhesive strength, according to the second experiment.

As shown in FIG. 15, the experimental example 2 evaluated an adhesive strength of the mold resin member 5 in the bobbin 3 having variously changed elastomer content ratios as described in detail below. The mold resin member 5 in the experimental example 2 was an epoxy resin which was the same as the experimental example 1.

In the experimental example 2, a total of 14 thin membrane formed samples, that had elastomer particles dispersed in polybutylene terephthalate resin were prepared. Incidentally, the 14 samples had different elastomer content ratios. The elastomer content ratio for each sample was 0.0% (mass percent), and 1%, 2%, 2.5%, 3%, 4%, 5%, 6%, 7%, 8%, 9%, 10%, 11% and 12% respectively.

The epoxy resin was coated on each surface of the 14 samples. At this point, the epoxy resin was applied to the surface of each sample so that a contacting surface of the epoxy resin on each sample was 4 $mm^2$. An M4 hexagonal nut was adhered to a surface of the epoxy resin of each sample after which the epoxy resin was solidified by heating.

Thereafter, the hexagonal nut adhered to each sample was pulled at a tensile stress velocity of 5 mm per minute, at room temperature. A tensile strength between each sample and the epoxy resin at a point of tearing therebetween was measured as an adhesion strength of each sample. Results from the second experiment are shown in FIG. 15.

From FIG. 15, it was found that the adhesion strength between the bobbin 3 and the mold resin member 5 gradually increased until the content ratio of the elastomer was 6%. That is, when the elastomer content ratio was gradually increased from 0% to 6%, the adhesion strength also gradually increased. However, an elastomer content ratio of more than 6% gradually decreased the adhesion strength between the bobbin 3 and the mold resin member 5. Furthermore, an elastomer content ratio of 10% was substantially the same value as a more preferable minimum range of 3% demonstrated in the experiment example 1. Also, once the elastomer content ratio was increased to more than 10%, the adhesion strength was lower than the more preferable minimum range of 3% which was demonstrated in experimental example 1. As shown in experimental example 1, by increasing the elastomer content ratio of the bobbin 3 to 3% or more, a continuously formed elastomer layer 34 on the bobbin 3 can be obtained, and as shown in the experimental example 2, by having the elastomer content ratio in a range of 3% to 10% the adhesion strength between the bobbin 3 and the mold resin member 5 can be secured.

While the present disclosure has been illustrated and described in detail in the drawings and the foregoing description, this should be considered as illustrative and not restrictive in character. It is understood that not only preferred embodiments have been presented, and modifications that come within the spirit of the disclosure are desired to be protected. For example, in the preferred embodiment, the dispersed phase particles are elastomer, however they are not limited to the materials described. The bobbin can be made from various materials as long as the resin is a thermoplastic resin which has dispersed phase particles with a lower elasticity than the thermoplastic resin. In foregoing, the thermoplastic resin is polybutylene terephthalate (PBT resin), however polyphenylene sulfide resin (PPS resin) or polyphenylene ether (PPE resin) can also be employed.

REFERENCE SIGN LIST

1 Ignition coil for an internal combustion engine, 21 primary coil, 22 secondary coil, 3 bobbin, 4 center core, 5 mold resin member

What is claimed is:

1. An ignition coil for an internal combustion engine, the ignition coil comprising:

a center core;

a bobbin having an axial direction, a circumferential direction, a radial direction and an inner space extending in the axial direction, the bobbin being made of thermoplastic resin and dispersed phase particles dispersed in the thermoplastic resin, the dispersed phase particles being lower in elasticity than the thermoplastic resin and having the center core disposed in the inner space in close contact with the bobbin;

a primary coil directly wound around the bobbin in the circumferential direction;

a secondary coil magnetically connected to the primary coil; and a mold resin member in which the primary coil, the secondary coil, the bobbin, and the center core are embedded in the inner space, wherein the bobbin includes an elastomer layer on an outer circumferential surface of the bobbin and a skin layer disposed on the outer circumferential surface of the elastomer layer, in the radial direction, the skin layer being in direct contact with the primary coil that is disposed on the outer circumferential surface of the skin layer.

2. The ignition coil for an internal combustion engine according to claim 1, wherein the dispersed phase particles are elastomer.

3. The ignition coil for an internal combustion engine according to claim 1, wherein the thermoplastic resin is polybutylene terephthalate resin.

4. The ignition coil for an internal combustion engine according to claim 1, wherein the thermoplastic resin is either polyphenylene sulfide resin or polyphenylene ether resin.

5. The ignition coil for an internal combustion engine according to claim 1, wherein the bobbin has an elastomer content ratio in a range of 3 to 10 percent mass.

6. The ignition coil according to claim 1, wherein the bobbin has a cross section having corners, when viewed in the axial direction.

7. An ignition coil for an internal combustion engine, the ignition coil comprising:

a center core;

a bobbin having an axial direction, a circumferential direction, a radial direction and an inner space extending in the axial direction and the center core disposed on the inner space in close contact with the bobbin;

a primary coil directly wound around the bobbin in the circumferential direction;

a secondary coil magnetically connected to the primary coil; and a mold resin member in which the primary coil, the secondary coil, the bobbin, and the center core are embedded in the inner space, wherein the bobbin includes an elastomer layer disposed on an outer circumferential surface of the bobbin and a skin layer disposed around the outer circumferential surface of the elastomer layer, the skin layer is in direct contact with the primary coil that is disposed on the outer circumferential surface of the skin layer, the elastomer layer being formed of cohered elastomer particles, and the skin layer being formed of thermoplastic resin and dispersed phase particles of elastomer which are dispersed in the thermoplastic resin, the cohered elastomer particles having a lower elasticity than the thermoplastic resin.

8. The ignition coil for an internal combustion engine according to claim 7, wherein the bobbin has an elastomer content ratio in a range of 3 to 10 percent mass.

9. The ignition coil for an internal combustion engine according to claim 8, wherein the thermoplastic resin is polybutylene terephthalate resin.

10. The ignition coil for an internal combustion engine according to claim 8, wherein the thermoplastic resin is either polyphenylene sulfide resin or polyphenylene ether resin.

11. The ignition coil for an internal combustion engine according to claim 7, wherein the thermoplastic resin is polybutylene terephthalate resin.

12. The ignition coil for an internal combustion engine according to claim 7, wherein the thermoplastic resin is either polyphenylene sulfide resin or polyphenylene ether resin.

13. The ignition coil according to claim 7, wherein the bobbin has a cross section having corners, when viewed in the axial direction.

* * * * *